US009459074B2

(12) United States Patent
Heim et al.

(10) Patent No.: US 9,459,074 B2
(45) Date of Patent: Oct. 4, 2016

(54) SYSTEM, METHOD AND APPARATUS FOR SECURING VALUABLES

(71) Applicants: Jeffrey R. Heim, St. Petersburg, FL (US); Richard Allen Angwin, Spring Hill, FL (US)

(72) Inventors: Jeffrey R. Heim, St. Petersburg, FL (US); Richard Allen Angwin, Spring Hill, FL (US)

( * ) Notice: Subject to any disclaimer, the term of this patent is extended or adjusted under 35 U.S.C. 154(b) by 0 days.

(21) Appl. No.: 14/563,386

(22) Filed: Dec. 8, 2014

(65) Prior Publication Data

US 2015/0114861 A1 Apr. 30, 2015

Related U.S. Application Data

(63) Continuation-in-part of application No. 14/288,750, filed on May 28, 2014, now Pat. No. 8,931,422, which is a continuation of application No. 13/970,792, filed on Aug. 20, 2013, now Pat. No. 8,770,116, which is a continuation of application No. 13/670,568, filed on Nov. 7, 2012, now Pat. No. 8,534,206, which is a continuation of application No. 13/472,590, filed on May 16, 2012, now Pat. No. 8,327,777, which is a continuation of application No. 12/652,453, filed on Jan. 5, 2010, now Pat. No. 8,201,426.

(51) Int. Cl.

| | |
|---|---|
| ***F41C 33/06*** | (2006.01) |
| ***E05B 65/00*** | (2006.01) |
| ***E05G 1/00*** | (2006.01) |
| ***E05G 1/026*** | (2006.01) |
| ***E05C 19/16*** | (2006.01) |
| *E05B 37/00* | (2006.01) |
| *E05B 47/00* | (2006.01) |

(52) U.S. Cl.

CPC ..... *F41C 33/06* (2013.01); *E05B 65/0075* (2013.01); *E05C 19/166* (2013.01); *E05G 1/005* (2013.01); *E05G 1/026* (2013.01); *E05B 37/00* (2013.01); *E05B 47/00* (2013.01); *Y10S 224/912* (2013.01); *Y10T 70/5031* (2015.04)

(58) Field of Classification Search

CPC ..... E05B 2047/0073; E05B 2047/0076; E05B 2047/0086; E05B 65/0075; E05B 17/0041; E05B 17/2034; E05B 17/2053; E05B 37/00; E05B 47/00; E05G 1/005; E05G 1/026; E05G 1/02; E05G 1/04; F41C 33/06; Y10S 224/912; F41A 23/18; Y10T 70/5031; E05C 19/006

USPC ..... 70/63, 159–162; 109/45, 48, 50–52, 54; 206/1.5; 224/912

See application file for complete search history.

(56) References Cited

U.S. PATENT DOCUMENTS

| | | | |
|---|---|---|---|
| 1,423,804 | A | 7/1922 | Kontrowitz |
| 1,924,365 | A | 8/1933 | Mariotti |
| 2,643,397 | A | 6/1953 | Ehrenreich |

(Continued)

*Primary Examiner* — Suzanne Barrett

(74) *Attorney, Agent, or Firm* — Larson & Larson, P.A.; Frank Liebenow

(57) ABSTRACT

A safe includes a safe body that has an opening. A door is movably interfaced to the safe body such that the door selectively occludes the opening, thereby, selectively permitting access to the opening in one position and precluding access to the opening in a second position. A locking mechanism engages between the door and the safe body when the door occludes the opening. When provided with a key, the locking mechanism disengages between the door and the safe body, permitting access to the opening. An insert is positioned within the safe body. The insert has an opening formation configured to support at least one specific weapon, which is arranged to be accessed from the opening.

14 Claims, 6 Drawing Sheets

(56) References Cited

U.S. PATENT DOCUMENTS

| | | | | | |
|---|---|---|---|---|---|
| 3,464,606 | A | | 9/1969 | Nordeen | |
| 3,468,576 | A | | 9/1969 | Beyer et al. | |
| 3,780,487 | A | * | 12/1973 | Munson | F41C 33/06 206/317 |
| 4,276,667 | A | | 7/1981 | Osbourne | |
| 4,483,501 | A | | 11/1984 | Tillman | |
| 4,570,888 | A | | 2/1986 | Evans | |
| 4,691,396 | A | | 9/1987 | Hoffman | |
| 4,716,632 | A | | 1/1988 | Perl | |
| 4,768,021 | A | | 8/1988 | Ferraro | |
| 4,788,838 | A | | 12/1988 | Cislo | |
| 4,800,822 | A | | 1/1989 | Adkins | |
| 4,807,315 | A | | 2/1989 | Wachenheim | |
| 4,869,449 | A | | 9/1989 | Goodman | |
| 4,890,466 | A | | 1/1990 | Cislo | |
| 5,009,088 | A | | 4/1991 | Cislo | |
| 5,056,342 | A | | 10/1991 | Prinz | |
| 5,111,545 | A | | 5/1992 | Krozal | |
| 5,111,755 | A | | 5/1992 | Rouse | |
| 5,172,575 | A | | 12/1992 | Fisher | |
| 5,317,888 | A | | 6/1994 | Towns | |
| 5,621,996 | A | * | 4/1997 | Mowl, Jr. | F41A 23/18 211/64 |
| 5,732,914 | A | | 3/1998 | Flinn | |
| 5,901,589 | A | | 5/1999 | Cordero | |
| 5,916,087 | A | | 6/1999 | Owens | |
| 5,987,941 | A | | 11/1999 | Zocco | |
| 5,996,865 | A | * | 12/1999 | Bissey | B60R 7/043 206/37 |
| 6,260,300 | B1 | | 7/2001 | Klebes | |
| 6,318,134 | B1 | | 11/2001 | Mossberg et al. | |
| 6,523,374 | B1 | | 2/2003 | Owens | |
| 6,584,719 | B1 | * | 7/2003 | Morford | B60R 7/14 224/551 |
| 6,843,081 | B1 | | 1/2005 | Painter | |
| 7,159,711 | B1 | * | 1/2007 | Gardner | F41C 33/06 206/315.11 |
| 7,299,667 | B1 | | 11/2007 | Miresmaili | |
| 7,434,427 | B1 | | 10/2008 | Miresmaili | |
| 7,516,709 | B2 | * | 4/2009 | Bartel | E05D 15/56 109/48 |
| 7,546,920 | B1 | | 6/2009 | Horn et al. | |
| 8,074,477 | B1 | | 12/2011 | Weiche | |
| 8,104,313 | B2 | | 1/2012 | Wolfe | |
| 8,186,188 | B1 | | 5/2012 | Brown | |
| 8,201,426 | B2 | | 6/2012 | Heim et al. | |
| 8,327,777 | B2 | | 12/2012 | Heim et al. | |
| 8,484,809 | B2 | | 7/2013 | Fiedler | |
| 8,534,206 | B2 | | 9/2013 | Heim et al. | |
| 8,770,116 | B2 | | 7/2014 | Heim et al. | |
| 8,833,274 | B2 | * | 9/2014 | Bartel | E05G 1/00 109/48 |
| 2003/0037506 | A1 | | 2/2003 | Seibert | |
| 2004/0232182 | A1 | * | 11/2004 | Ingram | B60R 7/14 224/401 |
| 2006/0112741 | A1 | | 6/2006 | Engel | |
| 2007/0138806 | A1 | | 6/2007 | Ligtenberg et al. | |
| 2008/0237939 | A1 | * | 10/2008 | McDonnough | A45C 13/02 264/500 |
| 2010/0243492 | A1 | * | 9/2010 | Bulthuis, Jr. | F41C 33/06 206/317 |
| 2011/0174200 | A1 | * | 7/2011 | Bartel | E05G 1/00 109/59 T |
| 2014/0197057 | A1 | * | 7/2014 | Hogue | F41C 33/06 206/317 |

* cited by examiner

SYSTEM, METHOD AND APPARATUS FOR SECURING VALUABLES

CROSS-REFERENCE TO RELATED APPLICATION

This application is a continuation of U.S. patent application Ser. No. 14/288,750, filed May 28, 2014, which is a continuation of U.S. Pat. No. 8,770,116 issued Jul. 8, 2014, which is a continuation of U.S. Pat. No. 8,534,206 issued Sep. 17, 2013, which is a continuation of U.S. Pat. 8,327,777, issued Dec. 11, 2012, which is a continuation of U.S. Pat. No. 8,201,426, issued Jun. 19, 2012, the disclosures of both are hereby incorporated by reference.

FIELD

This invention relates to the field of security and more particularly to a system, method and apparatus for securing valuables such as guns.

BACKGROUND

It is well known in the art to provide secure storage for valuables such as jewelry, guns, currency, and the like. Lock boxes, safes, gun safes, etc, are well known for such purposes. Often, these safes or lock boxes or locked cabinets have key locks, combination locks and/or biometric locks (e.g. fingerprint readers). Depending upon the security level required, such devices are sometimes made out of very heavy, thick steel, reducing the risk of unauthorized access to the contents while, due to the weight, reducing the risk of the entire device being removed. Also, or in addition, sometimes these devices are hidden and/or secured in place. For example, it is well known to screw a safe into a wall, and then hide the safe behind a painting or other ornament.

In general, these devices have several features in common. They have a box-like construction, sealed on five sides; they have a door that is connected to the box-like portion by hinges and they have a locking device that prevents the door from opening without the proper access key (physical key, password, biometric match, combination, etc).

Several problems exist in the prior art. Depending upon the thickness of the safe/box and door and the gap between the door and the box, it is possible to pry open some such devices by inserting a lever between the box and the door, Another problem in some installations is that there isn't enough room for a door to swing open such as when the safe is attached to a bed frame between the bed and furniture or bed and wall. In some situations, quick and ready access to the contents of the safe are required such as when an intruder alarm sounds when the occupant sleeps. In some situations, due to the size and low weight of the safe, it is desired to attach the safe to a larger, heavier object. Many of these problems are not addressed in the prior art as well as other limitations that will be obvious in the following description.

What is needed is a system, method, and apparatus for securing valuables, and in particular, for securing weapons in an upright, easy to find and grasp position.

SUMMARY

A safe or strong box attachment mechanism is disclosed. The safe (or strong box) has a rotatable door that, when a proper code/combination/biometric is provided, rotatably opens to expose the contents. The safe/strong-box optionally attaches to a bed system by a plate that has barbs. The barbed plate readily inserts between a box spring and a mattress, but due to the barbs, is difficult to remove without lifting the mattress from the box spring making it at least difficult to remove by, for example, children in the home.

In one embodiment, a safe is disclosed having a safe body that has an opening. A door is movably interfaced to the safe body such that the door selectively occludes the opening, thereby, selectively permitting access to the opening in one position and precluding access to the opening in a second position. A locking mechanism engages between the door and the safe body when the door occludes the opening. When provided with a key, the locking mechanism disengages between the door and the safe body, permitting access to the opening. An insert is positioned within the safe body. The insert has an opening formation configured to support at least one specific weapon, which is arranged to be accessed from the opening.

In another embodiment, a method of providing quick access to a protected weapon is disclosed. The method includes providing a safe that has a body and the safe body has an opening. A door is movably interfaced to the safe body such that the door selectively occludes the opening, thereby, the door permitting access to the opening in one position and precluding access to the opening in a second position. A locking mechanism engages between the door and the safe body when the door occludes the opening. When provided with a key, the locking mechanism disengages between the door and the safe body, permitting access to the opening. The method includes providing the key to unlock the locking mechanism and thereby opening the door. Next, a first insert is installed into the safe body through the opening. The first insert has a cavity formed to accept a first weapon. Next, the first weapon is placed within the first cavity such that a portion of the first weapon extends from the first cavity for fast access and the door is closed and locked. To open, the key to the locking mechanism is provided and the locking mechanism releases the door responsive to the key, thereby providing access to the first weapon. Now, for example when changing to a different weapon, the first weapon is removed from the first cavity and the first insert is removed from the safe body. A second, different insert is installed into the safe body through the opening. The second insert has a second cavity formed to accept a second weapon; the second weapon being of a different size and/or shape than the first weapon. Now, the second weapon is placed within the second cavity such that a portion of the second weapon extends from the second cavity for fast access and the door is closed and locked. Later, the key to the locking mechanism is provided and the locking mechanism releases the door responsive to the key, thereby providing access to the second weapon.

In another embodiment, a safe is disclosed including a body that has an opening for receiving and holding an object. A door is rotatably interfaced to the safe body by a pin. The door has a curved outer surface, a curved inner surface, and side surfaces covering a portion of each side of the door. The door obstructs the opening in a first position of rotation, and provides access to the safe body through the opening when the door is in a second position of rotation. A locking mechanism engages between the door and the safe body when the door is rotated to the first position of rotation thereby holding the door in the first position of rotation until the locking mechanism is released. Upon releasing by the locking mechanism, the door is free to rotate towards the second position of rotation. An insert is located within the safe body. The insert has a cavity that is open towards the opening and is form fit to a weapon such that when a weapon is inserted into the cavity, a portion of the weapon extends from the cavity for quick and easy grasping by a user. The door rotates to be at least partially contained within the safe body in the second position of rotation.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
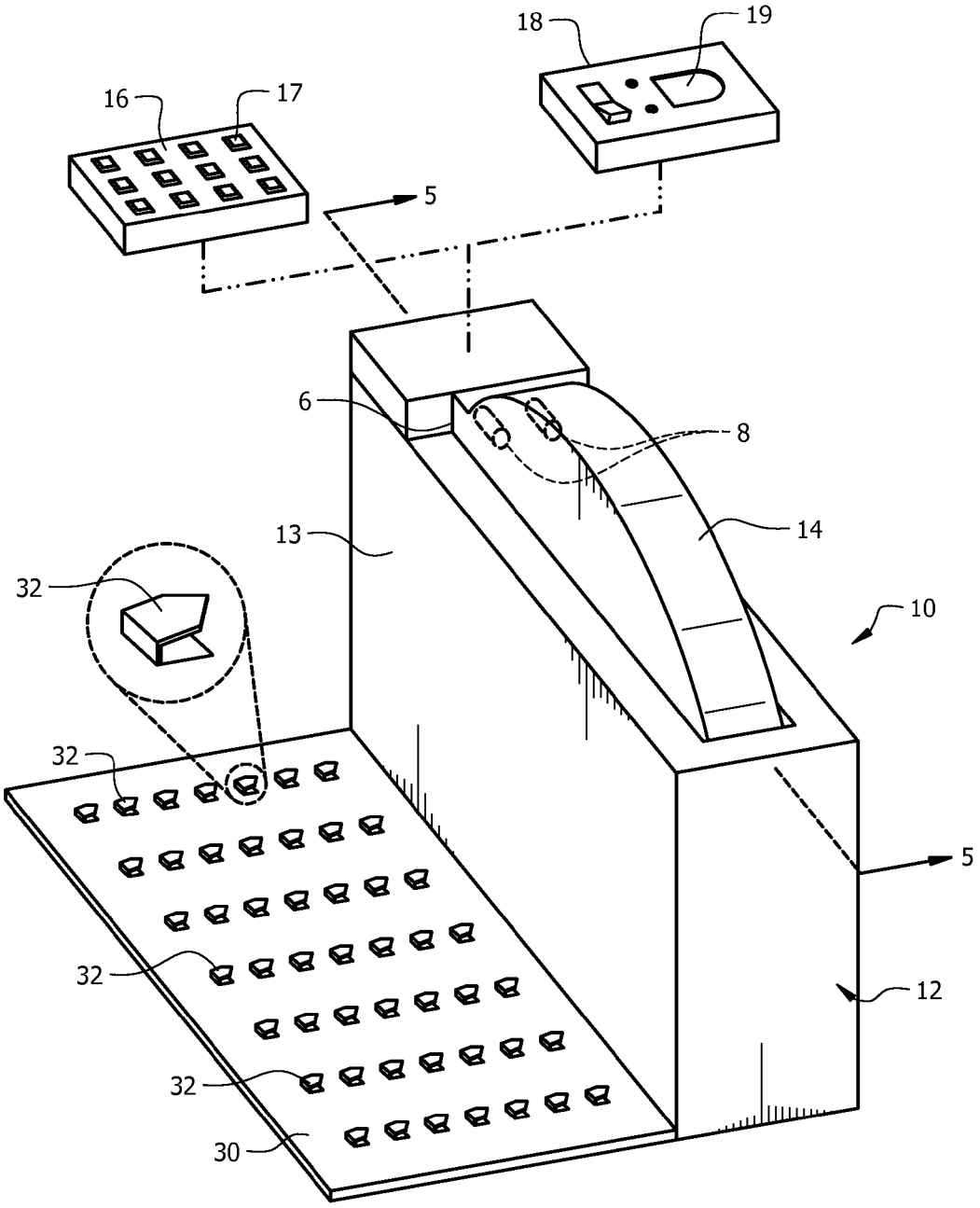
FIG. 1 illustrates a perspective view of the apparatus for securing valuables in a closed/locked position.

Reference will now be made in detail to the presently preferred embodiments of the invention, examples of which are illustrated in the accompanying drawings. Throughout the following detailed description, the same reference numerals refer to the same elements in all figures. Throughout the description, the term safe is used to represent any such device such as a vault, safe, strong box, gun safe, locked cabinet, locked drawer, etc., that is used to store items and reduce the possibility of loss of the items to theft, fire, etc. The possibility of loss is reduced by making the safe difficult to remove, heavy, sturdy, tamper resistant, affixed to a larger item, affixed to a structure, fire resistant, etc.

Safes, vaults, strong boxes, gun safes, etc. of the prior art generally have a hinged door that swings outwardly and locks when in the closed position. Generally, the door is often almost as wide and high as the actual storage portion of the, e.g., safe. The size of the door requires sufficient space in front of the safe for the door to open wide enough as to access its contents. Furthermore, for some safe systems, the gap between the door and the body or box portion of the safe provides an opening in which a thief is able to pry open some safe doors, reducing security of the safe. In some circumstances, it is imperative to readily and quickly access a content of the safe, for example, to access a ready hand gun when an intruder is present in an individual's home. With conventional safes, once the door is opened, the contents have to be reached for within the safe body. Speed of access, ease of finding the weapon and silence are several important features helpful the survival of the individual under such exemplary circumstances.

Figure 2:
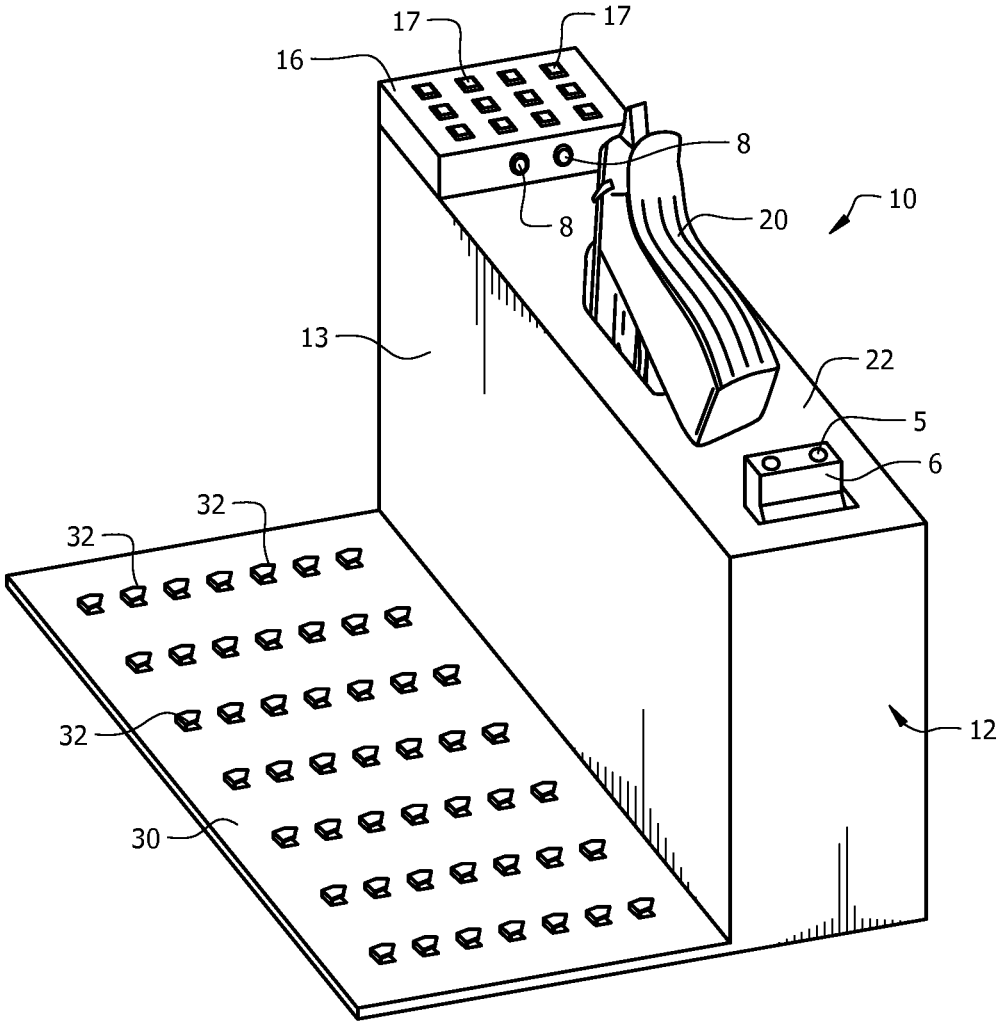
FIG. 2 illustrates a perspective view of the apparatus for securing valuables in an open position.

To overcome the limitations of existing technology as cited above and others, the safe 10 of FIG. 1 has a rotating door 14 that, after entering the proper code on a combination lock 16 or presenting a known biometric parameter (e.g. fingerprint, voice print) on a biometric sensor 18, the rotating door 14 rotates into an open position as shown in FIG. 2. By operating the rotating door 14, the contents (e.g. gun 20 as in FIG. 2, pepper spray or other weapon) are readily and immediately accessible without undue searching (as required within a cavity of prior safes). As discussed previously, the operation of the rotating door 14 requires minimal clearance with other objects such as headboards, night stands, etc. and, in some embodiments, is noise dampened so as to not alert an intruder of its operation. Furthermore, the sides of the rotating door 14, in some embodiments, extend into the base 12 when the rotating door 14 is closed, thereby reducing risk of a theft or access from prying open the rotating door 14.

The safe 10 has a base 12 that contains the items to be protected such as a gun 20 and an insertion place 30 as will be described later.

Any known locking system is anticipated including a combination lock 16 with a grid or linear set of keys 17, a biometric device 18 such as a finger print scanner 18 with finger print detection pad 19, a key access (not shown), electronic security card (not shown), smart card (not shown), electronic key fob (not shown), etc. All such devices are known in the art and included here within. For example, in one embodiment, the locking system has a sensor that senses the proximity of a key fob (as used with some newer vehicles), and when the key fob is proximal (e.g. on the nightstand, near the safe 10), the lock is energized to open, quickly, with the operation of a simple button or latch, etc.

The locking system 16/18 mechanically operates a locking mechanism such as one or more locking pins 8. When locked, the rotating door 14 is in the closed position and the locking mechanism (e.g. locking pins 8) are extended into mating receptacles 5 of the locking end 6 of the rotating door 14, thereby preventing access to the contents of the safe 10. After the correct code, combination, key, biometric object, etc, is presented to the locking system 16/18, the locking mechanism (e.g. locking pins 8) retract and permit opening of the rotating door 14. In some embodiments, after the locking mechanism (e.g. locking pins 8) retracts, the user pushes on the rotating door 14 to turn it and obtain access to the contents. In a preferred embodiment, the rotating door 14 is spring loaded (see FIG. 5/5A) and, upon retraction of the locking mechanism (e.g. locking pins 8), the loaded spring 52 (see FIG. 5/5A) unloads, automatically opening the rotating door 14. Any type of spring/energy storage mechanism is anticipated including expansion springs, compression springs, torsion springs, coil springs, opposing same poles of magnets, gas springs, etc.

It is anticipated that the safe 10 be made of any sturdy material such as steel, heavy plastic, wood, aluminum, etc, depending upon the level of security needed. For example, some existing gun racks are made of wood with glass windows. In as such, these gun racks lock to reduce access by youngsters, but a thief with a hammer is able to easily break the glass and takes the guns. It is also anticipated that the safe 10 be made to any size as needed for the weapon, valuables, etc that are to be protected.

In some embodiments, the safe 10 is anticipated to be just large enough to hold a hand gun 20. Since this embodiment and others are relatively small, it is difficult to prevent removal of such a safe 10 since it is not to large nor heavy to carry by most people, including some youngsters. To make it more difficult to remove such embodiments of the safe 10, the safe 10 is coupled to a plate 30 that has barbs 32 on one or both sides. The barbs 32 point in towards the base 12 of the safe 10 such that when inserted between two objects such as a mattress 62 and box spring 64 (see FIG. 3), it is difficult to pull the plate 30 out from between the objects. This provides resistance to being removed by a person who is not capable of lifting the top object (e.g. mattress 62) while disengaging the barbs 32. Performance of such a removal would be impossible for a young child and difficult for some older children and even difficult for many adults. This deters many family members from removing the safe 10 from, for example, between the mattress 62 and bed spring 64, especially since after removal that family member would still be unable to open the rotating door 14. It is even more difficult to remove the safe 10 that is coupled to the plate 30 when located between a bed 60 (see FIG. 3) and a wall (not shown).

Although the plate 30 is shown interfaced or connected to the safe 10, it is anticipated that the plate 30 is used with any other type/style of safe/strong-box such as a safe or strong-box with a typical linear hinge opening arrangement. The plate 30 provides additional security to such devices. In such, the plate 30 is attached, screwed, glued, welded to, or is part of the safe/strong-box.

Figure 3:
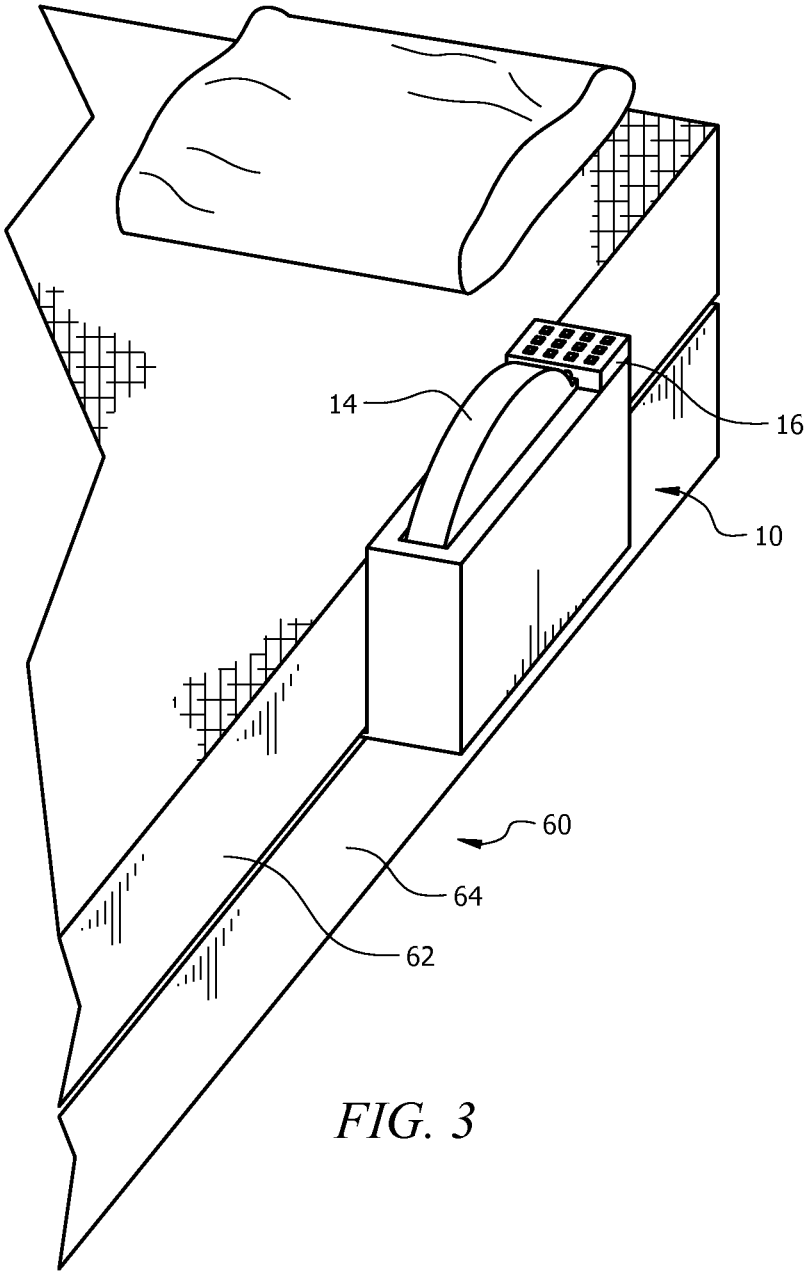
FIG. 3 illustrates a perspective view of the apparatus for securing valuables in a closed/locked position secured to a bed.

Referring to FIG. 3, a perspective view of the apparatus for securing valuables (e.g. the safe 10) shown interfaced to, for example, a bed system 60 in a closed/locked position. It is anticipated that the safe 10 be interfaced to any suitable object such as the bed system 60 as shown, for example, a night stand, dresser, wall, etc. In the example shown in FIG. 3, the insertion plate 30 (not visible) has been pushed in between the mattress 62 and the box spring 64. Once the plate 30 is inserted between the mattress 62 and the box spring 64, it is difficult to remove by way of the barbs 32 that point towards the safe 10. If one tries to pull the plate 30 out from between the mattress 62 and the box spring 64, the barbs 32 dig into the mattress 62 and/or the box spring 64, making it difficult or impossible to remove by the ordinary person. Remove is accomplished by lifting the mattress 62 and disengaging the barbs 32 from the mattress 62 and/or the box spring 64. Most mattresses 62 are heavy and difficult for many single adults to lift, let alone hold suspended above the box spring 64 while working to disengage the barbs 32. The plate 30/barb 32 holding mechanism as shown is anticipated to deter most younger members of a household from removing the safe 10, even though once they removed the safe 10 from the bed system 60, it is difficult to gain access to the safe 10 without the key, combination, code, biometric match, etc. Of course, a seasoned thief will be able to remove the safe 10 from the bed system 60, but most conceivable mounting mechanisms of any safe to a bed system 60 are able to be defeated by a thief having the appropriate tools.

Figure 4:
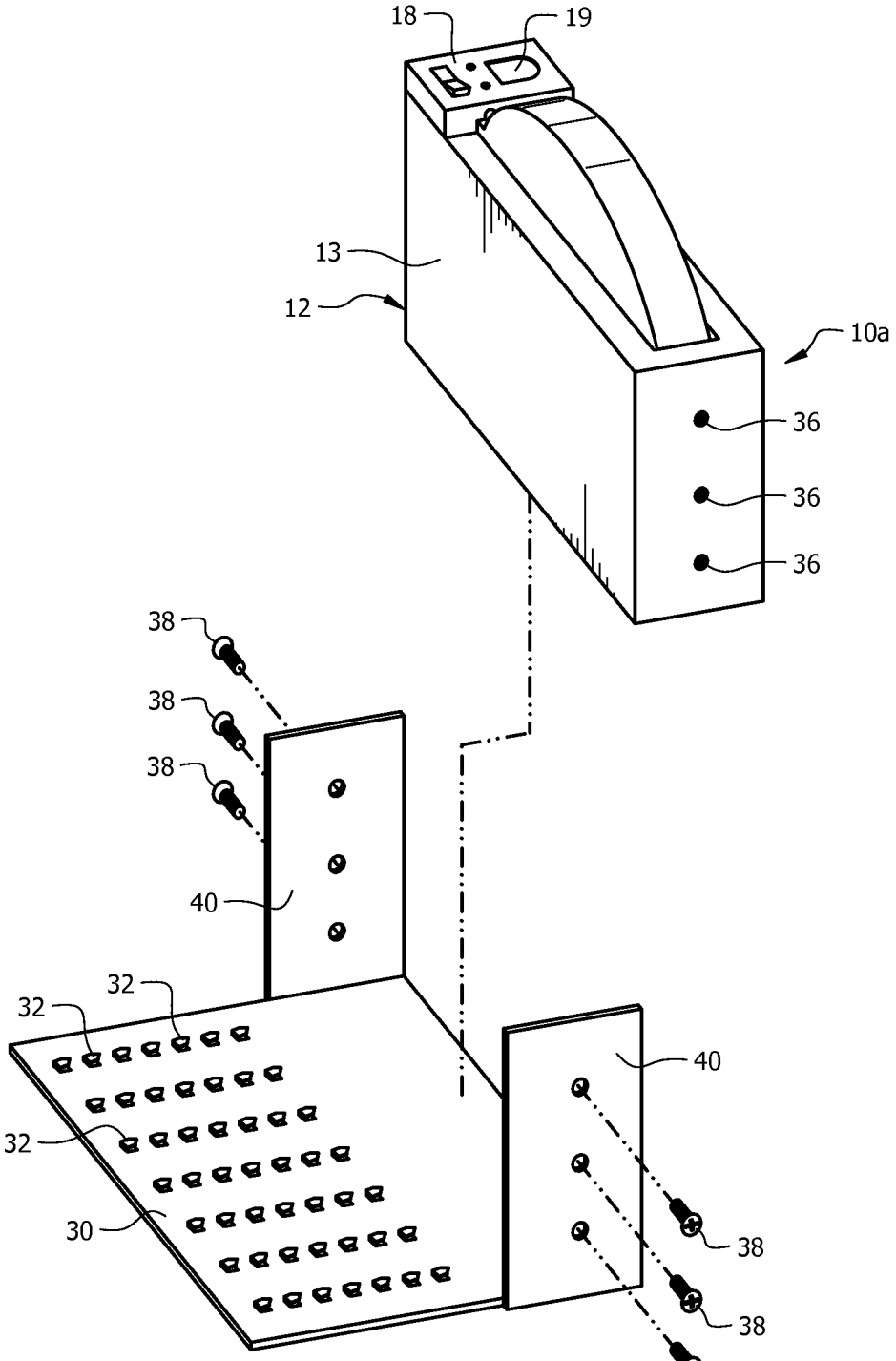
FIG. 4 illustrates a perspective view of the apparatus for securing valuables interfaced to a detachable/adjustable bed interface system.

Referring to FIG. 4, a perspective view of the apparatus for securing valuables is shown interfaced to a detachable/adjustable plate. It is anticipated that the safe 10 of the present invention be used with or without the plate 30 and barbs 32. For example, in some uses, the safe 10, without the plate 30 and barbs 32, is screwed into a heavy, large object such as a bed frame (not shown) a dresser (not shown), etc.

Furthermore, because some mattresses 62 (see FIG. 3) are thicker than other mattresses 62 and it is desired to have the safe 10 open with ready access to the handle of the gun 20 or other weapon, for thicker mattresses 62, the safe 10 is desired to be higher with respect to the bottom of the mattress 62. To this means, the embodiment shown in FIG. 4 includes a plate 30 with barbs 32 on one side or both sides of the plate 30. The plate 30 has mounting brackets 40 on one or both sides for affixing the plate 30 to the safe 10 in any way known in the industry such as using screws 38 that pass through the brackets 40, through walls of the safe 10 and are bolted from within the safe 10, preferably with tamper resistant screws/bolts (e.g., locked with a cotter pin or the like). In this way, the safe 10 is capable of being positioned higher with respect to the plate 30 by using only the top two holes in the brackets 40 and the lower two holes in the wall of the safe 10, etc. It is anticipated that any number of holes, slots, screws, fasteners etc are used for various mounting configurations. Furthermore, other mechanisms are known in the industry for mounting objects to each other, all of which are included here within.

In some embodiments, the safe 10 is affixed to the plate 30 and is removable from the plate 30 or other device after the door 14 is opened or by an external lock, for example, a pad lock. In such, the safe 10 is secured to an object such as the bed system 60 and, when traveling, is removed from the object or plate 30 and taken by the owner, for example, into a vehicle. In such, it is anticipated that the safe 10 be carried in the vehicle and optionally, mounted/locked to the vehicle for added theft deterrence.

Figure 5A:
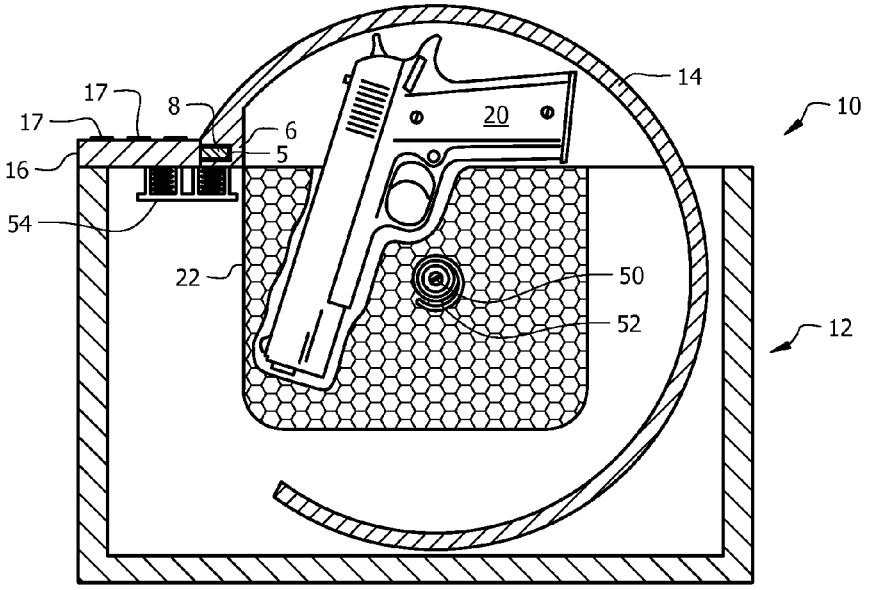
FIG. 5A illustrates a sectional view of an embodiment of the apparatus for securing valuables in a closed/locked position.
Figure 5B:
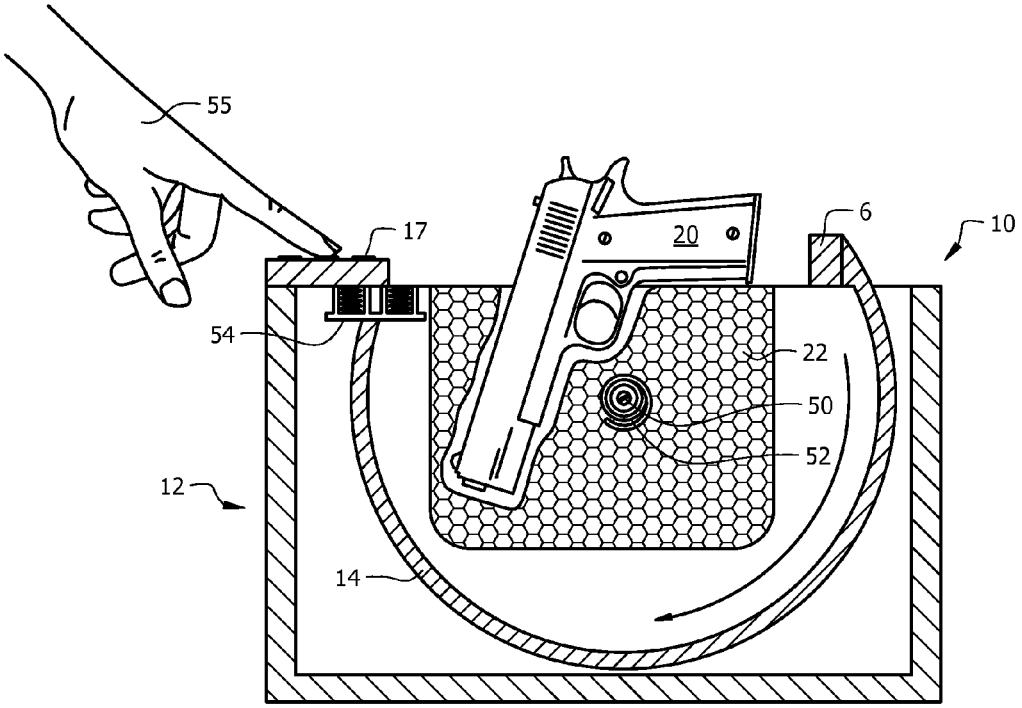
FIG. 5B illustrates a sectional view of the embodiment of the apparatus for securing valuables in an open position.

Referring to FIGS. 5A and 5B, a sectional view of the apparatus for securing valuables in a closed/locked position (FIG. 5A) and in an open position (FIG. 5B) are shown. In this view it is shown how the rotating door 14 rotates into the open position providing access to the contents of the safe 10, in this example, providing access to the handle end of a gun 20.

In FIG. 5A, the safe 10 is in the closed position and access to the gun 20 is denied. In FIG. 5B, an authorized user 55 has, for example, pressed the correct sequence of buttons 17 on the combination lock 16 and the door 14 has automatically rotated to the open position.

In one embodiment, the gun 20 or other weapon is supported in a form fitted material 22 such as foam rubber, Styrofoam, etc. In this way, the gun 20 or other weapon is held in a ready-to-use position for fast access during an emergency such as a home intrusion. This position provides additional safety from inadvertent firing of some weapons being that the gun 20 faces down when the, possibly frantic, owner reaches for the gun 20.

In some embodiments, replaceable/interchangeable form fitted material 22 is provided with different opening formations to hold different sizes of guns 20 or other weapons. For example, in one embodiment, the form fitted material 22 has a cylindrical cavity sized to hold a can of pepper spray (not shown) while in other embodiments, the form fitted material 22 is cut to the shape of the gun 20 or other weapon and/or has sections that are easily removed to increase the size of the form opening, thereby holding larger guns 20 or other weapons.

In some embodiments, the rotating door 14 is supported by a bearing 50 and the bearing is affixed to a surface of the side walls 13 of the base 12. Many arrangements of axles, partial axles, side stubs, etc. are known, all of which are included here within. In other embodiments, the rotating door 14 is rotatably interfaced to the base 12 in any of many known ways including various types of bearings and rotating interfaces. Still in other embodiments, the rotating door 14 is supported by (held within) a sleeve (not shown) on one side or both sides of the rotating door 14 within the base 12.

In some embodiments, the rotating door 14 is spring loaded by, for example, a coil spring 52. In this example, one end of the coil spring 52 is interfaced to the base 12 and the other end of the coil spring 52 is interfaced to the rotating door 14 so that when the rotating door 14 is closed (locked)

as in FIG. 5A, the coil spring 52 is tensioned and when the rotating door 14 is later released (unlocked), the coil spring 52 uncoils and pushes the rotating door 14 to the open position as in FIG. 5B.

Because the safe 10 is often used in a situation where it is important that little or no audible noise is made during access, in some embodiments, dampers 54 softly stop the rotation of the rotating door 14. The dampers 54 are designed to slowly stop the rotating door 14 when it approaches the full open position. In some embodiments, the dampers 54 are soft; cushion material such as rubber, resilient foam, etc. In some embodiments, the dampers 54 include springs or spring assemblies. In some embodiments, the dampers 54 are combinations of resilient material, springs or any other known damping mechanism.

Figure 6A:
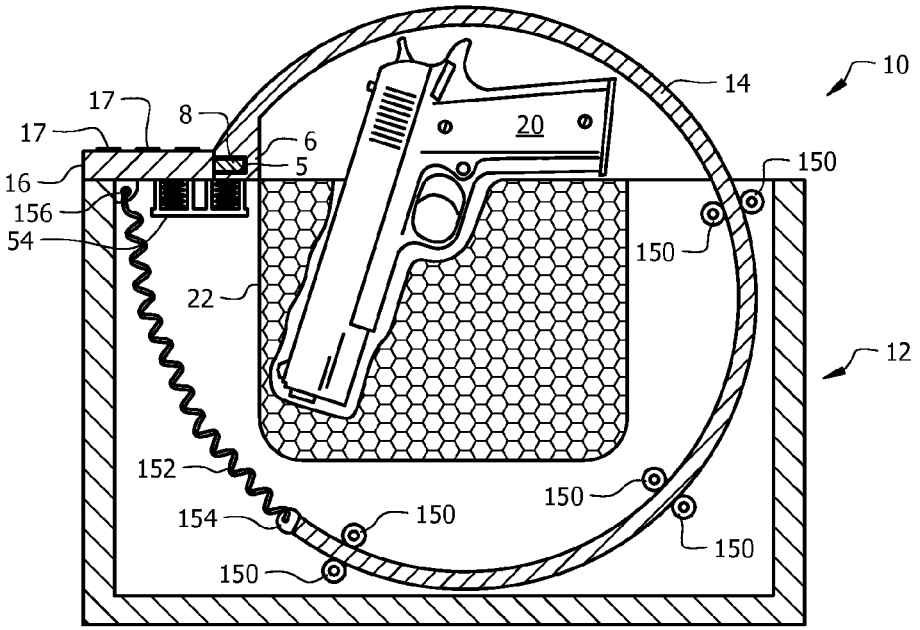
FIG. 6A illustrates a sectional view of another embodiment of the apparatus for securing valuables in a closed/locked position.
Figure 6B:
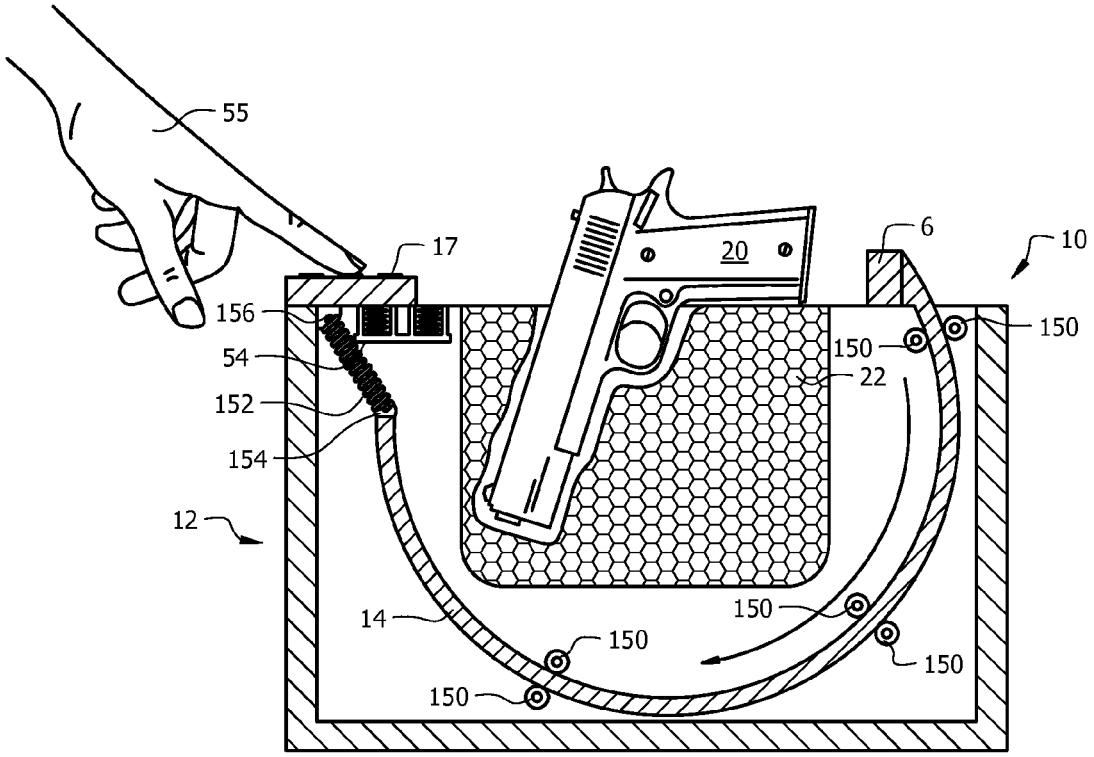
FIG. 6B illustrates a sectional view of the other embodiment of the apparatus for securing valuables in an open position.

Referring to FIGS. 6A and 6B, a sectional view of the apparatus for securing valuables in a closed/locked position (FIG. 6A) and in an open position (FIG. 6B) are shown. In this view it is shown how the rotating door 14 rotates into the open position providing access to the contents of the safe 10, in this example, providing access to the handle end of a gun 20.

In FIG. 6A, the safe 10 is in the closed position and access to the gun 20 is denied. In FIG. 6B, an authorized user 55 has, for example, pressed the correct sequence of buttons 17 on the combination lock 16 and the door 14 has automatically rotated to the open position.

In one embodiment, the gun 20 or other weapon is supported in a form fitted material 22 such as foam rubber, Styrofoam, etc. In this way, the gun 20 or other weapon is held in a ready-to-use position for fast access during an emergency such as a home intrusion. This position provides additional safety from inadvertent firing of some weapons being that the gun 20 faces down when the, possibly frantic, owner reaches for the gun 20.

In some embodiments, replaceable/interchangeable form fitted material 22 is provided with different opening formations to hold different sizes of guns 20 or other weapons. For example, in one embodiment, the form fitted material 22 has a cylindrical cavity sized to hold a can of pepper spray (not shown) while in other embodiments, the form fitted material 22 is cut to the shape of the gun 20 or other weapon and/or has sections that are easily removed to increase the size of the form opening, thereby holding larger guns 20 or other weapons.

In some embodiments, the rotating door 14 has a curved outer and/or inner surface that is supported by a rotational interface. In some embodiments, the rotational interface is a series of guide pins 150 or a continuous guide sleeve (not shown). Each guide pin (or the sleeve) is affixed to a surface of a wall (e.g. the side walls 13) of the base 12. In some embodiments, though not required, the door has side surfaces or partial side surfaces such as flat surfaces as shown in FIGS. 1, 3, and 4, to protect contents of the safe 10 from access. In such, the side surfaces cover all or part of the rotating door 14 that is exposed (e.g. outside of the base 12) when the rotating door 14 is rotated to the open position.

Many arrangements of pins 150 are anticipated, all of which are included here within. Although any suitably structurally supportive material is anticipated, in some embodiments, the pins 150 (or the sleeve) are made from a material having a low coefficient of friction such as hard plastic, polished steel, nylon, etc. In some embodiments, the pins 150 include bearings so that the pins 150 rotate as the door 14 rotates. In such, it is also anticipated that the pins 150 which rotate are made from a material having a low coefficient of friction such as hard plastic, polished steel, nylon, etc. Any of many pin 150 configurations is anticipated, including various types of bearings and rotating interfaces or combinations of pin 150 types. In some embodiments, the pins 150 are located both within and outside of the rotational arc of the door 14; while in other embodiments, the pins 150 are located either outside of the rotational arc of the door 14 or inside of the rotational arc of the door 14. A minimum number of pins 150 are required to properly hold the door 14 and prevent forced removal of the door 14. In this manner, the inside surface, outside surface, or both the inside and outside surface of the curved surface of the door 14 are slideably held in position to be ready to rotate (e.g. to an open position when the lock 16 is deactivated).

In some embodiments, the rotating door 14 is spring loaded by, for example, an expansion spring 152. In this example, one end of the expansion spring 152 is interfaced to the base 12 at, for example, a spring interface 156 and the other end of the expansion spring 152 is interfaced to an end of the rotating door 14 at a second spring interface 154 so that when the rotating door 14 is closed (locked) as in FIG. 6A, the expansion spring 152 is tensioned (stretched) and when the rotating door 14 is later released (unlocked), expansion spring 152 collapses and pulls the rotating door 14 to the open position as in FIG. 6B.

Because the safe 10 is often used in a situation where it is important that little or no audible noise is made during access, in some embodiments, dampers 54 softly stop the rotation of the rotating door 14, aided by the decrease in force from the expansion spring 152 as it reaches a collapsed state. The dampers 54 are designed to slowly stop the rotating door 14 when it approaches the full open position. In some embodiments, the dampers 54 are soft; cushion material such as rubber, resilient foam, etc. In some embodiments, the dampers 54 include springs or spring assemblies. In some embodiments, the dampers 54 are combinations of resilient material, springs or any other known damping mechanism. In some embodiments, the door is opened/close by operation of a motor (not shown) or other electrical device such as a solenoid, etc.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A safe comprising:

a safe body, the safe body having an opening;

a door, the door movably interfaced to the safe body such that the door selectively occludes the opening, thereby, permitting access to the opening in one position and precluding access to the opening in a second position;

a locking mechanism, the locking mechanism engages between the door and the safe body when the door occludes the opening, when provided with a key, the locking mechanism disengages between the door and the safe body and the door self-opens, permitting access to the opening; and a form fitted material within the safe body, the form fitted material having an opening formation configured to support at least one specific weapon in a position such that the one specific weapon is held completely within the safe in the second position and a portion of the at least one specific weapon extends outside of the opening in the form fitted material when the door is in the one position;

whereas the form fitted material is held within the safe body after the locking mechanism disengages between the door and the safe body in the one position.

2. The safe of claim 1, wherein the form fitted material is removable.

3. The safe of claim 1, wherein the form fitted material is made of foam rubber.

4. The safe of claim 3, wherein at least two inserts are provided, a first form fitted material in which the opening formation is shaped to hold a first specific weapon and a second form fitted material in which the opening formation is shaped to hold a second specific weapon.

5. The safe of claim 1, wherein:

the door has a curved outer surface and side surfaces covering at least a portion of the door, the door is rotatably interfaced to the safe body by a rotational interface, the door restricts access to the opening in a first position of rotation and the door provides access to the safe through the opening in a second position of rotation;

the locking mechanism is interfaced between the safe body and the door, the locking mechanism engages between the door and the safe body when the door is in the first position of rotation and, upon enabling access by providing a key to the locking mechanism, the locking mechanism disengages with the door, allowing the door to rotate into the second position of rotation; and an energy storing mechanism is interfaced between the door and the safe body.

6. The safe of claim 1, further comprising a plate affixed to the safe body, the plate having a plurality of barbs formed on at least one surface of the plate, the barbs pointing towards the safe body, such that it is easier to push the plate between two objects than it is to pull the plate out from between the two objects, whereas after being slid between a mattress and a box spring, the barbs dig into the mattress, thereby preventing removal of the plate from between the mattress and the box spring.

7. A method of providing quick access to a protected weapon, the method comprising:

providing a safe, the safe comprising:

a safe body, the safe body having an opening;

a door, the door movably interfaced to the safe body such that the door selectively occludes the opening, thereby, the door permitting access to the opening in one position and precluding access to the opening in a second position;

a locking mechanism, the locking mechanism engages between the door and the safe body when the door occludes the opening, when provided a key, the locking mechanism disengages between the door and the safe body, permitting access to the opening;

providing the key to unlock the locking mechanism and thereby the door self-opening;

inserting a first form fitted material into the safe body through the opening, the first form fitted material having a cavity, the first cavity formed to accept a first weapon;

placing the first weapon within the first cavity such that a portion of the first weapon extends from the first cavity for fast access;

closing and locking the door;

providing the key to the locking mechanism, the locking mechanism releasing the door responsive to the key, thereby providing access to the first weapon;

removing the first weapon from the first cavity;

removing the first form fitted material from the safe body;

inserting a second form fitted material into the safe body through the opening, the second form fitted material having a second cavity, the second cavity formed to accept a second weapon, the second weapon being of a different size and/or shape than the first weapon;

placing the second weapon within the second cavity such that a portion of the second weapon extends from the second cavity for fast access;

closing and locking the door;

providing the key to the locking mechanism, the locking mechanism releasing the door responsive to the key, thereby providing access to the second weapon.

8. The method of claim 7, wherein the first form fitted material and the second form fitted material are made of a foam material.

9. The method of claim 8, wherein the foam material is foam rubber.

10. The method of claim 8, wherein the foam material is polystyrene foam.

11. A safe comprising:

a safe body for holding an object, the safe body having an opening;

a door having a curved outer surface, a curved inner surface, and side surfaces covering a portion of each side of the door, the door is rotatably interfaced to the safe body by a pin, whereas the door obstructs the opening in a first position of rotation, and the door provides access to the safe body through the opening when the door is in a second position of rotation;

a locking mechanism, the locking mechanism engages between the door and the safe body when the door is rotated to the first position of rotation thereby holding the door in the first position of rotation until the locking mechanism is released and, upon releasing by the locking mechanism, the door is free to rotate towards the second position of rotation; and a form fitted material within the safe body, the form fitted material having a cavity that is open towards the opening, the cavity is form fit to a weapon such that when a weapon is inserted into the cavity, a portion of the weapon extends from the cavity for quick and easy grasping by a user;

whereas the door rotates to be at least partially contained within the safe body in the second position of rotation and the form fitted material remains within the safe body in the first position.

12. The safe of claim 11, wherein the form fitted material is made of a foam material.

13. The safe of claim 12, wherein the foam material is foam rubber.

14. The safe of claim 12, wherein the foam material is polystyrene foam.

* * * * *